US008224476B2

(12) United States Patent
Chu et al.

(10) Patent No.: US 8,224,476 B2
(45) Date of Patent: Jul. 17, 2012

(54) CLOSED-LOOP MONITORING AND IDENTIFICATION OF CD ALIGNMENT FOR PAPERMAKING PROCESSES

(75) Inventors: Danlei Chu, North Vancouver (CA); Cristian Gheorghe, North Vancouver (CA); Johan Backstrom, North Vancouver (CA)

(73) Assignee: Honeywell ASCa Inc., Mississauga (CA)

( * ) Notice: Subject to any disclaimer, the term of this patent is extended or adjusted under 35 U.S.C. 154(b) by 306 days.

(21) Appl. No.: 12/790,951

(22) Filed: May 31, 2010

(65) Prior Publication Data

US 2011/0290438 A1 Dec. 1, 2011

(51) Int. Cl.

| | |
|---|---|
| ***G06F 7/66*** | (2006.01) |
| *D21F 11/00* | (2006.01) |
| *D21F 13/00* | (2006.01) |
| *D21F 7/00* | (2006.01) |

(52) U.S. Cl. ..... 700/129; 700/127; 700/128; 162/198; 162/253

(58) Field of Classification Search ..... 700/127–129; 162/13, 198, 253

See application file for complete search history.

(56) References Cited

U.S. PATENT DOCUMENTS

| | | | | |
|---|---|---|---|---|
| 5,351,184 | A | 9/1994 | Lu et al. | |
| 5,400,258 | A * | 3/1995 | He | 700/129 |
| 5,561,599 | A | 10/1996 | Lu | |
| 5,572,420 | A | 11/1996 | Lu | |
| 5,574,638 | A | 11/1996 | Lu | |
| 5,853,543 | A | 12/1998 | Hu et al. | |
| 5,892,679 | A | 4/1999 | He | |
| 6,059,931 | A | 5/2000 | Hu et al. | |
| 6,080,278 | A * | 6/2000 | Heaven et al. | 162/198 |
| 6,086,237 | A | 7/2000 | Gorinevsky et al. | |
| 6,092,003 | A | 7/2000 | Hagart-Alexander et al. | |
| 6,149,770 | A | 11/2000 | Hu et al. | |
| 6,233,495 | B1 | 5/2001 | Chen | |
| 6,466,839 | B1 | 10/2002 | Heaven et al. | |
| 6,564,117 | B1 * | 5/2003 | Chen et al. | 700/129 |
| 6,650,947 | B2 | 11/2003 | Fu et al. | |
| 6,805,899 | B2 | 10/2004 | MacHattie et al. | |
| 6,807,510 | B1 * | 10/2004 | Backstrom et al. | 702/150 |
| 7,128,808 | B2 | 10/2006 | Metsala | |
| 7,300,548 | B2 * | 11/2007 | Tran et al. | 162/198 |
| 7,454,253 | B2 * | 11/2008 | Fan | 700/29 |
| 7,459,060 | B2 * | 12/2008 | Stewart | 162/198 |
| 7,577,483 | B2 * | 8/2009 | Fan et al. | 700/29 |
| 7,648,614 | B2 * | 1/2010 | Tran et al. | 162/263 |
| 7,689,296 | B2 * | 3/2010 | Backstrom et al. | 700/31 |

(Continued)

OTHER PUBLICATIONS

E.D. Mauro et al. "New on-line sensor for paper shrinkage measurement," Proceedings of 1994 Control Systems conference, Stockholm Sweden 1994.

(Continued)

*Primary Examiner* — Ramesh Patel
(74) *Attorney, Agent, or Firm* — Cascio Schmoyer & Zervas

(57) ABSTRACT

Alignment is a critical component for modeling a cross-directional (CD) papermaking process. It specifies the spatial relationship between individual CD actuators to paper quality measurements. Misalignment can occur unexpectedly due to sheet wander or CD shrinkage variation. In certain applications and circumstances, a misalignment of one third (⅓) actuator zone width can result in significant paper quality degradation. Detecting a misalignment and identifying CD alignment in closed loop are highly demanded in paper mills but these are nontrivial problems. A technique for maintaining proper CD alignment in sheetmaking systems entails monitoring the alignment online, triggering closed loop identification if misalignment is detected, and then deploying the new alignment. No personnel intervention is required.

20 Claims, 9 Drawing Sheets

U.S. PATENT DOCUMENTS

2004/0221978 A1* 11/2004 Tran et al. ..... 162/198
2008/0066884 A1* 3/2008 Tran et al. ..... 162/198

OTHER PUBLICATIONS

P.H. Viitaharju and H.W.Kropholler, "Dried-in shrinkage profiles of paper webs," TAPPI Journal, vol. 76, No. 8, 1993.

T.Wahlstrom, "Dryer section simulator for laboratory investigations of shrinkage profile." Proceedings of 2003 International Paper Physics Conference, Victoria Canada 2003.

A.R.Taylor and S.R.Stephen, "Detecting mis-mapping in cross-directional control systems," IEEE Transactions on Control System Technology, pp. 962-968 Jul. 2010.

T.Mast et al. "New optimization of CD control for global and localized profile performance," Proceedings of TAPPI Spring Technical Conference & Trade Fair, Chicago USA 2003.

C.Fu et al. "On-line mapping detection without compromising CD quality," Proceedings of 2008 Control Systems, Vancouver, Canada 2008.

S.R.Duncan "Estimating the response of actuators in a cross-directional control system," Proceedings of 1996 Control Systems, Halifax Canada 1996.

D.M.Gorinevsky and C. Gheorghe "Identification tool for cross-directional processes," IEEE Transactions on Control Systems Technology, vol. 11, No. 5, 2003.

S.Karimzadeh, Online detection of picketing and estimation of cross directional and machine direction variations using discrete cosine transform, Master's Thesis, Univ. of British Columbia, Vancouver, Canada 2008.

B.R.Phillips et al., "CD Shrinkage profiles in paper-curve fitting and quantitative analysis," Appita Journal of Peer Reviewed, vol. 55, No. 3, pp. 235-243, 2002.

S.J.I'Anson and H.W.Kropholler, "Enhancing visibility of wiremark by image analysis," Journal of Pulp and Paper Science, vol. 17, No. 1, pp. 22-26, 1991.

* cited by examiner

CLOSED-LOOP MONITORING AND IDENTIFICATION OF CD ALIGNMENT FOR PAPERMAKING PROCESSES

FIELD OF THE INVENTION

The present invention generally relates to techniques for monitoring and controlling continuous sheetmaking systems such as a papermaking machine and more, specifically to maintaining proper cross-directional (CD) alignment in sheetmaking systems by monitoring control performance in real time, detecting a misalignment, identifying the alignment in closed-loop, and updating a CD controller with the correct alignment model.

BACKGROUND OF THE INVENTION

In the art of making paper with modern high-speed machines, sheet properties must be continually monitored and controlled to assure sheet quality and to minimize the amount of finished product that is rejected when there is an upset in the manufacturing process. The sheet variables that are most often measured include basis weight, moisture content, gloss, and caliper (i.e., thickness) of the sheets at various stages in the manufacturing process. These process variables are typically controlled by, for example, adjusting the feedstock supply rate at the beginning of the process, regulating the amount of steam applied to the paper near the middle of the process, or varying the nip pressure between calendering rollers at the end of the process. A papermaking process typically has two types of directional control issues: machine direction (MD) control and cross direction (CD) control. MD refers to the direction of sheet travel and CD refers to the direction that is perpendicular to sheet travel.

A paper machine CD process is a large-scale two-dimensional system. The performance of a CD control, either a traditional single-input-single-output controller or an advanced model predictive controller, is highly dependent on the accuracy of CD alignment. In theory, CD alignment can be specified by using edge locations of paper web at both the actuator array side and the CD measurement array side and a CD nonlinear shrinkage profile. Both web edges and sheet shrinkage can change over time due to multiple causes, which result in misalignment issues. The causes include regular grade changes, variations in sheet tension between rolls, restraint during drying, and relative humility of the paper web itself. Current online methods that measure paper edges provide edge detectors to compensate for the sheet wander in closed loop however this technique is not able to detect the shape change of shrinkage profiles. Another online method measures CD shrinkage profile during the paper machine's normal operation. This technique uses wire marks, water marks, or felt marks, but these marks degrade the surface quality of the finished products.

When a CD process model alignment begins to differ from actual alignment, the CD control system is said to be misaligned. Misalignment of one third (⅓) of the actuator zone width can, in certain applications and circumstances, result in production loss as product fails to meet specifications. In addition, periodic variation patterns often referred to "picket fence" patterns in the actuator array are present. Actuator picketing causes product loss and degradation, wastes actuator energy and may cause physical damage to process equipment. When severe misalignment occurs, the CD controller must be detuned or switched off and realigned. Realignment typically entails an open-loop step test and automatic process identification and CD controller tuning. This realignment process disrupts normal paper production and is time consuming and tedious. Frequent and/or prolonged open-loop tests are undesirably as these lead to production inefficiency.

Systems that automatically map and align actuator zones to measurements points in sheetmaking systems have been developed. Some of these systems perform so-called "bump tests" by disturbing selected actuators and detecting their responses, typically with the CD control system in open-loop. The term "bump test" refers to a procedure whereby an operating parameter on the sheetmaking system, such as actuator setpoints of a papermaking machine, is altered and changes of certain dependent variables resulting therefrom are measured. Prior to initiating any bump test, the papermaking machine is first operated at predetermined baseline conditions. By "baseline conditions" is meant those operating conditions whereby the machine produces paper of acceptable quality. Typically, the baseline conditions will correspond to the current process conditions in open loop. Given the expense involved in operating the machine, extreme conditions that may produce defective, non-useable paper are to be avoided. In a similar vein, when an operating parameter in the system is modified for the bump test, the change should not be so drastic as to damage the machine or produce defective paper. After the machine has reached steady state or stable operations, certain operating parameters are measured and recorded. Sufficient number of measurements over a length of time is taken to provide representative data of the responses to the bump test.

For example, U.S. Pat. No. 5,400,258 to He discloses a standard alignment bump test for a papermaking system wherein an actuator is moved and a scanning sensor reads its response and the alignment is identified by the software. U.S. Pat. No. 6,086,237 to Gorinevsky and Heaven discloses a similar technique but with more sophisticated data processing. Specifically, in their bump test the actuators are moved and technique identifies the response as seen by the scanner.

More recent approaches to monitoring and identifying CD alignment include U.S. Pat. No. 6,564,117 to Chen et al which describes a process whereby the CD profile of a web of material be produced is monitored and controlled. This passive closed-loop identification technique cannot identify severe misalignments and cannot run in open-loop. U.S. Pat. No. 7,128,808 to Metsala et al. describes a method for identifying mapping that employs a mapping model that takes the linear and non-linear shrinkage of paper web into account. This open-loop nonlinear shrinkage identification algorithm requires that the shrinkage profile be divided into three sections. U.S. Pat. No. 7,459,060 to Stewart describes closed-loop identification of CD controller alignment but this approach cannot handle actuator constraints and cannot be applied to multivariable CD control systems. Finally, U.S. Pat. No. 7,648,614 to Tran et al. describes an elaborate method of controlling CD mapping in a web that requires generating at least two analysis rule profiles from data. The technique requires much testing and computer memory.

SUMMARY OF THE INVENTION

The present invention is able to monitor and identify CD alignment in closed loop without adding extra measurements associated with the inventive online methods. The present invention is based in part on the development of a real-time, closed-loop cross-directional alignment system that has three novel features: picketing detection, closed-loop identification, and online deployment. While the system is particularly suited for papermaking processes it can be applied to any sheet forming processes.

To detect misalignment, the inventive method measures "actuator picketing," which refers to a specific actuator setpoint profile pattern that is dominated by high spatial frequency components and looks similar to a picket fence. This phenomenon is a well-known symptom associated with CD alignment problems. For a well-tuned and well-aligned CD controller, the actuator setpoint profile typically contains a limited amount of high, spatial frequency components. After performing spectrum analysis on actuator setpoint profile, if the accumulated power within a certain high spatial frequency band exceeds a pre-specified threshold, one can conclude that the actuator picketing is detected and the misalignment is present. The pre-specified threshold is defined by carrying on a controller performance baselining, which is an effective way to quantify control performance and determine the thresholds for picketing detection. To improve the detection algorithm robustness, the spectrum analysis for measurement profiles can be optionally added in the online monitoring of present invention. This invention is able to avoid the fault detection caused by overly aggressive controller tuning after adding measurement profiles into the analysis. The misalignment detection method of the present invention can account for the effects of spatial response shape change that is needed for predicting the outputs accurately.

With respect to alignment identification, the present invention employs an alignment identification algorithm that is able to extract the open-loop shape response using closed-loop experimental data. The algorithm can tolerate 100% process time-delay uncertainties and, in addition, CD alignment is identified by one-step optimization instead of iterative updating. A novel closed loop intelligent PRBS (Pseudo-Random Binary Sequence) test is introduced in the closed-loop identification. The magnitude, location and duration of PRBS excitation can be automatically determined by this invention based on the constraints and setpoints of CD actuators. Compared with traditional persistent "bump," PRBS tests reduce the additional CD variances in the sheet triggered by identification experiments. Because of the nature of closed-loop tests, process disturbances can still be rejected by feedback controllers during the identification. A matrix inversion formula is employed to extract the open loop responses from closed-loop experiment data. Statistic signal processing and constrained nonlinear optimization techniques are adopted for full response shape identification. Although this algorithm is particularly suited for alignment identification, it can be extended to identify the entire CD spatial model in closed loop. Both the linear and nonlinear shrinkage are supported by the present invention.

In one aspect, the invention is directed to a method for detecting misalignment of a sheetmaking system having a plurality of actuators arranged in the cross-direction and having a cross-directional (CD) controller for providing control to a spatially-distributed sheet process, which is employed in the sheetmaking system, the method including the steps of:

(a) operating the system and measuring a profile of the sheet along the cross-direction of the sheet downstream of a plurality of actuators and generating a profile signal that is proportional to a measurement profile;
(b) tuning the cross-directional controller with an acceptable CD alignment;
(c) initiating artificial misalignment;
(d) performing baselining operations to establish baseline threshold detection conditions;
(e) monitoring the operating conditions;
(f) signaling misalignment when operating conditions exceed the threshold detection conditions.

In another aspect, the invention is directed to a method of closed-loop alignment identification of a sheetmaking system having a plurality of actuators arranged in the cross-direction and having a cross-directional (CD) controller for providing control to a spatially-distributed sheet process, which is employed in the sheetmaking system, the method including the steps of:

(a) initiating a closed-loop pseudo-random binary sequence (PRBS) tests to generate experimental data;
(b) extracting non-parametric open-loop responses from the experimental data;
(c) identifying alignment by using identified non-parametric open-loop responses;
(d) validating the alignment; and
(e) signaling online deployment based on alignment validation.

In yet another aspect, the invention is directed to an online method of deploying alignment of a sheetmaking system having a plurality of actuators arranged in the cross-direction wherein the system includes a controller for adjusting outputs of the plurality of actuators in response to sheet profile measurements that are made downstream from the plurality of actuators wherein the controller is initially operated under original tuning parameters, the method including the steps of:

(a) detecting cross-directional misalignment;

(b) identifying cross-directional alignment by implementing a closed-loop pseudo-random binary sequence (PRBS) bump test; and (c) validating identified cross-directional alignment whereby (i) if the identified alignment is determined to be within a first range that is referred to as being good, the identified alignment is transferred to the controller with the proviso that in the case where the CD had been detuned prior to step (b) and provided with more conservative tuning parameters, the CD is restored with the original tuning parameters; (ii) if the identified alignment is determined to be within a second range that is referred to as being fair, the identified alignment is transferred to the controller with the proviso that that in the case where the CD had been detuned prior to step (b) and provided with more conservative tuning parameters, the CD is not restored with the original tuning parameters; and (iii) if the identified alignment is determined to be within a third range that is referred to as being poor, the identified alignment is not transferred.

In a further aspect, the invention is directed to a method of alignment of a sheetmaking system having a plurality of actuators arranged in the cross-direction wherein the system includes a controller for adjusting output to the plurality of actuators in response to sheet profile measurements that are made downstream from the plurality of actuators, the method including the steps of:

(a) detecting misalignment that includes the steps of:
  (i) operating the system and measuring a profile of the sheet along the cross-direction of the sheet downstream of the plurality of actuators and generating a profile signal that is proportional to a measurement profile;
  (ii) inject artificial misalignment;
  (iii) performing baselining operations to establish baseline threshold detection conditions;
  (iv) monitoring the operating conditions;
  (v) signaling misalignment when operating conditions exceed the threshold detection conditions;
(b) identifying alignment that includes the steps of:
  (i) initiating a closed-loop pseudo-random binary sequence (PRBS) bump tests to generate experimental data;

(ii) extracting open-loop responses from the experimental data;

(iii) identifying alignment by using open-loop responses;

(iv) validating the alignment; and (v) signaling online deployment based on alignment validation; and (c) deploying the alignment.

DETAILED DESCRIPTION OF PREFERRED EMBODIMENTS

Figure 1:
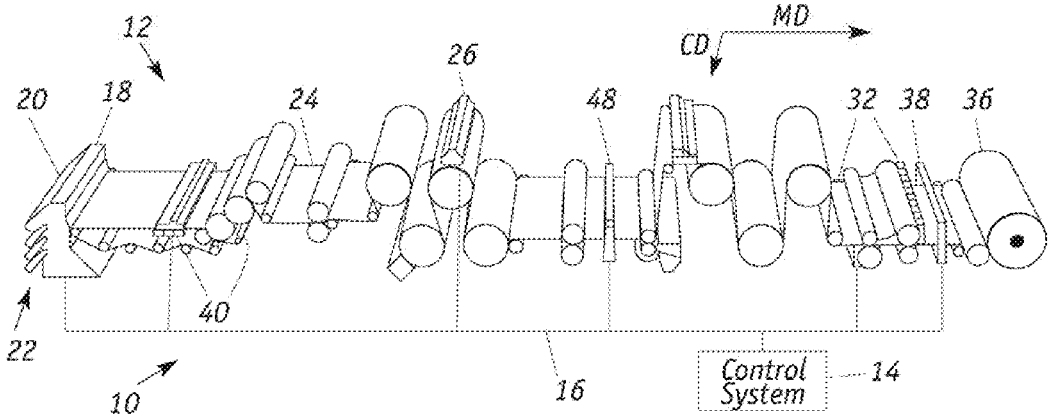
FIGS. 1 and 2 are schematic illustrations of a papermaking system.

The inventive closed-loop monitoring and identification CD alignment method will be illustrated by implementing the technique in a sheetmaking system 10 that includes papermaking machine 12, control system 14 and network 16 as illustrated in FIG. 1. The papermaking machine 12 produces a continuous sheet of paper material 24 that is collected in take-up reel 36. The paper material 24 is produced from a pulp suspension, comprising of an aqueous mixture of wood fibers and other materials, which undergoes various unit operations that are monitored and controlled by control system 14. The network 16 facilitates communication between the components of system 10. In practice, the portion of the papermaking process near a headbox 20 is referred to as the "wet end", while the portion of the process near a take-up reel 36 is referred to as the "dry end."

The papermaking machine 12 includes headbox 20 that incorporates an array of dilution actuators 22 and an array of slice lip actuators 18. Dilution actuators 22 distribute water into the pulp suspension and slice lip actuators 18 are arranged to control discharge of wetstock onto a supporting wire or web along the CD. The sheet of fibrous material that forms on top of the wire is trained to travel in the machine direction (MD) toward reel 36. An array of steam actuators 40 controls the amount of hot steam that is projected along the CD. The hot steam increases the paper surface temperature and allows for easier cross direction removal of water from the paper sheet. Also, to reduce or prevent over drying of the paper sheet, further downstream, the paper material 24 is sprayed with water in the CD. An array of rewet shower actuators 26 controls the amount of water that is applied along the CD. Prior to being collected in reel 36, the sheet of paper material is pressed in a calendaring process whereby the paper sheet is fed between a series of rolls; the point between two rolls through which the paper sheet passes is called the nip. An array of induction heating actuators 32 applies heat along the CD to one or more of the rollers to control the roll diameters and thereby the size of the nips. As the paper sheet pass through each nip, the caliper (thickness) of the sheet along the CD can be varied.

Papermaking machine 12 is also equipped with a plurality of scanners 38, 48. Each scanner can comprise a set of sensors positioned along the CD or each scanner can comprise one or more sensors that are continuously scanned to measures properties of the sheet in the CD. When a sensor array is employed, the array measures the instantaneous CD profile. Controller system 14 can include a profile analyzer that is connected to scanning sensors 32, 38 and actuators 18, 22, 26, 32 and 40. The profile analyzer, which is computer, responds to the cross-directional measurements from scanners 38, 48, which generate signals that are indicative of the magnitude of a measured sheet property, e.g., caliper, dry basis weight, gloss or moisture, at various cross-directional measurement points.

Figure 2:
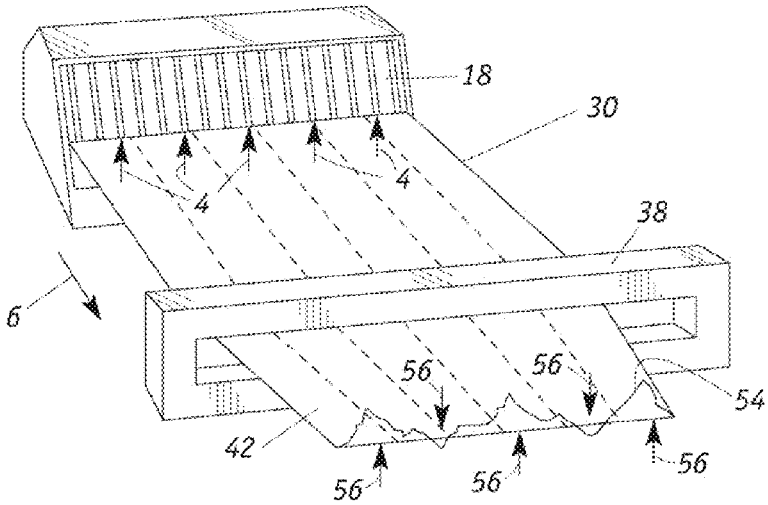

As depicted in FIG. 2, the amount of feedstock that is discharged of through the gap for any given actuator on the headbox can be adjusted by controlling individual actuator 18. The feed flow rates through the gaps ultimately affect the properties of the finished sheet material. As illustrated, a plurality of actuators 18 configured in the cross direction over web 30 that is moving in the machine direction indicated by arrow 6. Actuators 18 can be manipulated to control sheet parameters in the cross direction. A scanning device 38, located downstream from the actuators, measures one or more sheet characteristics. In this example, several actuators 18 are displaced as indicated by arrows 4 and the resulting changes in sheet property is detected by scanner 38 as indicated by the scanner profile 54. By averaging many scans of the sheet, the peaks of profile 54 indicated by arrows 56 can be determined. The alignment is defined by the relationship between the locations of peaks 56 and the locations of the centers of the displaced actuators 18 as indicated by arrow 4.

It is understood that the inventive technique is sufficiently flexible as to be applicable for online implementation with any large-scale industrial multiple actuator array and multiple product quality measurements cross-directional process that is controlled by a single-input-single-output (SISO) controller or by a multivariable model predictive controller (MPC) such as in papermaking. Suitable paper machine processes where paper is continuously manufactured from wet stock are further described, for instance, in U.S. Pat. No. 6,805,899 to MacHattie et al., U.S. Pat. No. 6,466,839 to Heaven et al., U.S. Pat. No. 6,149,770, to Hu et al., U.S. Pat. No. 6,092,003 to Hagart-Alexander et al, U.S. Pat. No. 6,080,278 to Heaven et al., U.S. Pat. No. 6,059,931 to Hu et al., U.S. Pat. No. 6,853,543 to Hu et al., and U.S. Pat. No. 5,892,679 to He, which are all assigned to Honeywell International, Inc. and are incorporated herein by reference. MPC techniques are described, for instance, in U.S. Pat. No. 5,351,184 to Lu et al., U.S. Pat. No. 5,561,599 to Lu, U.S. Pat. No. 5,572,420 to Lu, and U.S. Pat. No. 5,574,638 to Lu; and MPC for papermaking processes is described U.S. Pat. No. 6,807,510 to Backstrom and He, all of which are assigned to Honeywell International, Inc. and which incorporated herein by reference.

Figure 3:
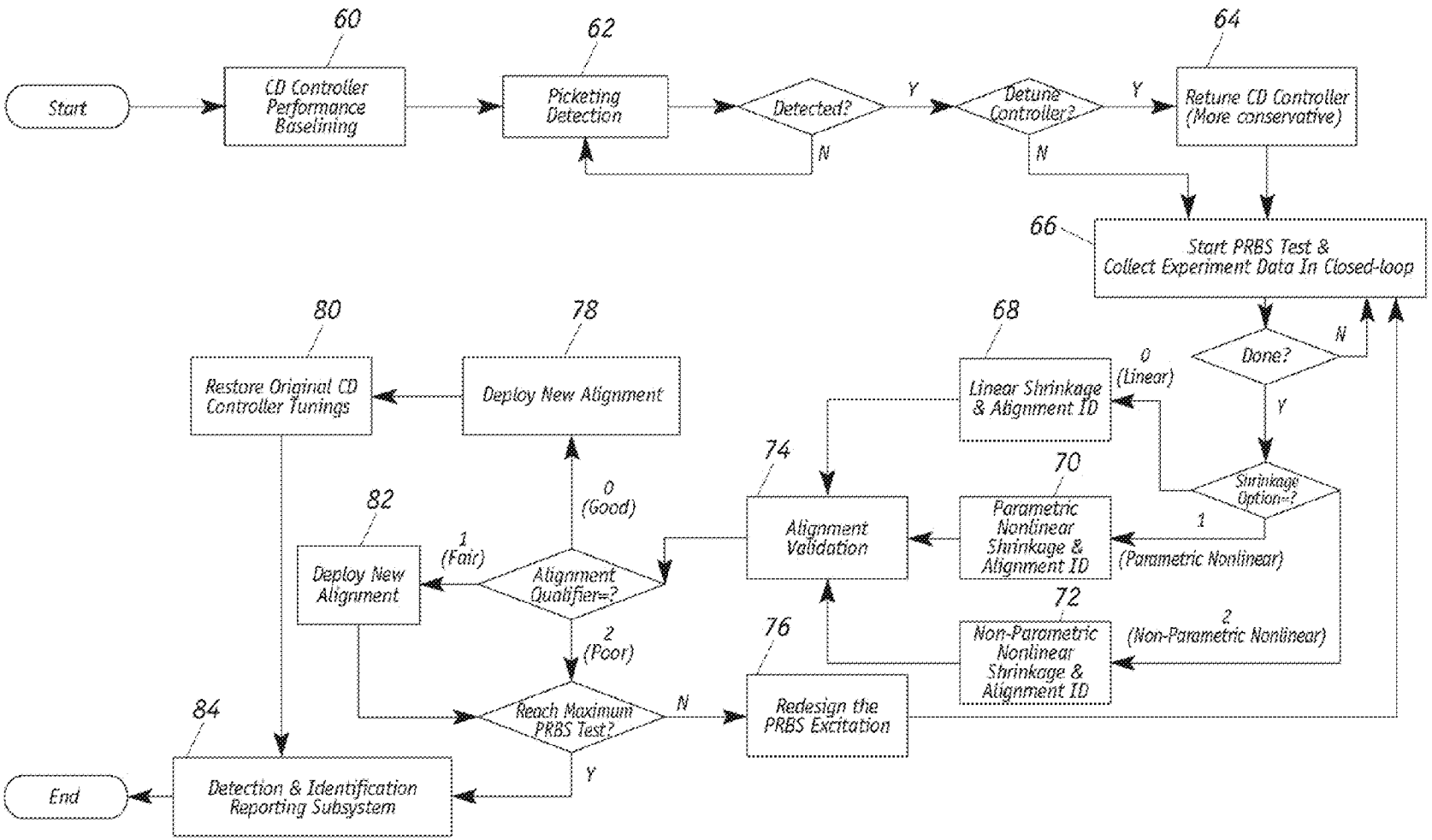
FIG. 3 is a block diagram of the inventive closed-loop cross-directional alignment process.

FIG. 3 illustrates an embodiment for implementing the closed-loop monitoring and identification of CD alignment for papermaking processes. It has three major components: detection, identification, and deployment. The detection component provides the thresholds for picketing detection and dynamically alignment monitoring. It starts with the CD Controller Performance Baselining step (60), where the maximum high spatial frequency accumulated powers for both actuator setpoints profiles and measurement profiles are generated. These maximums are used as picketing detection thresholds in the Picketing Detection step (62). If the current accumulated powers are higher than these thresholds, a misalignment is considered to have occurred. Subsequently, once picketing is detected, the PRBS Testing (66) step can proceed directly. Alternatively, the CD controller can be detuned before the PRBS test is initiated. The step of retuning the CD controller (64) with more conservative tuning parameters allows the controller to tolerate the misalignment and stabilizes the CD feedback system.

The identification component is preferably triggered automatically when picketing is detected, subject to optional detuning (64). The identification process commences with PRBS testing whereby experiment data are collected for the closed-loop identification algorithm. Whenever a PRBS test is completed, based on the set up of the Shrinkage Option (linear (68), parametric nonlinear (70), or nonparametric nonlinear (72)), the corresponding closed-loop Alignment ID (identification) algorithm is executed. The identified alignment feeds in an Alignment Validation block (74). Based on the model validation results (good, fair or poor), the algorithm triggers online deployment.

The deployment component defines the logic of implementing the identified alignment based on the output of Alignment Validation block (74). In a preferred protocol, if the identified alignment is rated as Good, the new alignment (78) is deployed, and original more aggressive controller tuning parameters (80) is restored if the controller was detuned at the beginning of the PRBS test. If the identified alignment is rated as Fair, the new alignment (82) is also deployed, but the controller still uses more conservative tuning parameters if the controller was detuned at the beginning of the PRBS test. Finally, if the identified alignment is rated as Poor, the new alignment is dropped. For both the fair and poor cases, PRBS excitation parameters are redesigned (76) and another PRBS test (66) is conducted as long as the Maximum PRBS Test has not been reached. Before completing the process, a detection and identification report (84) is provided. The logic assures that after deploying the new alignment, the overall closed loop CD performance will be improved. The whole process is fully automated and adaptive. No personnel intervention required.

1. Algorithms. This section provides the details of the detection and the closed loop identification algorithms.

1.1 Picketing Detection. Actuator picketing is a well-known symptom of misalignments and is used as an indicator to trigger the closed loop identification in the invention. In particular, an improved cumulative sum (CUSUM) algorithm is used for picketing detection. This concept is based in part on the recognition that the occurrence of actuator picketing results in the growth of the high frequency components in actuator power spectrum. Whenever the accumulated power in a certain high frequency band is higher than a pre-specified threshold, actuator picketing is detected. How to setup the threshold for the detection is the critical aspect but the solution is non-intuitive. For the present invention, the improved CUSUM algorithm reduces the conservativeness of the original CUSUM algorithm. In addition, performance baselining is introduced to automatically determine the thresholds for picketing detection.

Let's consider a setpoint profile u(t). t is the time flag, i.e., the index of scans. So, the notation u(t,i) represents the setpoint of the ith individual actuator at instant The power spectrum of u(t) can be calculated by performing discrete Fourier transform (DFT), i.e., $$U(t,k)=\sum_{i=1}^{n}u(t,i)e^{-\frac{j2\pi}{N}(i-1)(k-1)},\ k=1,2,\ldots,N, \tag{1}$$

where n is the number of actuators which are involved in the analysis, N is the number of discrete spatial frequency points, and U(t,k) is the complex power at instant t with the kth spatial frequency component. Therefore, the accumulated power in a high spatial frequency band $[k_1, k_2]$ can be calculated by $$P^{u}_{k_1\to k_2}(t)=\frac{1}{N}\sqrt{\sum_{k=k_1}^{k_2}U(t,k)\cdot conj(U(t,k))}, \tag{2}$$

where conj refers to complex conjugate. If at instant $t_1$ the condition $$P_{k_1\to k_2}{}^{u}(t_1)>\delta_u \tag{3}$$

does hold, the actuator picketing probably occurs. Here $\delta_u$ is pre-defined the threshold on the actuator high frequency accumulated power. To prevent the fault detection caused by overly aggressive controller tuning the power spectrum analysis for measurement profile is optionally added into the picketing detection too. Similar to (2), we can define the accumulated power in a high spatial frequency band $[k_3, k_4]$ for measurement by, $$P^{y}_{k_3\to k_4}(t)=\frac{1}{N}\sqrt{\sum_{k=k_3}^{k_4}Y(t,k)\cdot conj(Y(t,k))}. \tag{4}$$

In the same fashion, Y(t, k) is defined as the complex power for measurement profile y(t) at instant t with the kth spatial frequency component. Similar to (3), a condition for measurement accumulated power in a high frequency band is applied $$P_{k3\to k_4}{}^{y}(t_2)>\delta_y. \tag{5}$$

where $t_2$ is the instant when the accumulated power in the frequency band $[k_3, k_4]$ exceeds the threshold $\delta_y$.

If both the conditions (3) and (5) are satisfied, we will say at instant $t_o=\max(t_1,t_2)$, the actuator picketing is detected. Here $\delta_y$ is the pre-defined threshold on the measurement high frequency accumulated power. Both $\delta_u$ and $\delta_y$ can be determined by carrying on a controller performance baselining. The way to baseline a process is that an artificial small amount of misalignment is injected into real process (either inducing sheet wander or changing the overall shrinkage) when the process is well-tuned and well-aligned. By calculating both $P_{k_1\to k_2}{}^{u}(t)$ in (2) and $P_{k_3\to k_4}{}^{y}(t)$ in (4) over a certain scan horizon, say 50 scans, the thresholds $\delta_u$ and $\delta_y$ are defined by the maximums of $P_{k_1\to k_2}{}^{u}(t_{max}{}^{u})$ and $P_{k_3\to k_4}{}^{y}(t_{max}{}^{y})$ during the baselining. $t_{max}{}^{u}$ and $t_{max}{}^{y}$ stand for the instants when the maximum accumulated high frequency powers for actuator setpoint profiles and quality measurement profiles are obtained during the baselining process. It can be seen that both $\delta_u$ and $\delta_y$ can be regarded as not only thresholds for picketing detection, but also indicators for controller under-performance. The whole process of picketing detection is automated and no user-intervention required. Three major advantages of this algorithm are: (1) It is able to detect the picketing before any signs of picketing are visible to operators; (2) It is a simple algorithm that can be easily implemented; and (3) The novel baselining technique makes baselining for picketing detection much easier.

1.2 Closed-Loop Identification

Figure 4:
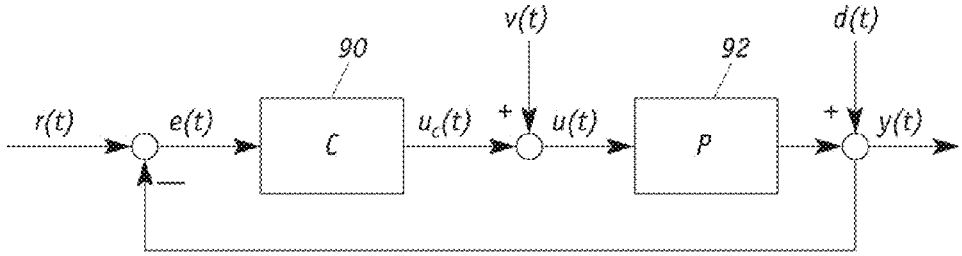
FIG. 4 is a schematic of the inventive closed-loop cross-directional alignment system.

FIG. 4 illustrates an embodiment the closed-loop cross-directional alignment process for a sheetmaking system such as that shown in FIG. 1. In FIG. 4, P (92) is a CD process and C (90) is a feedback CD controller (either a traditional SISO controller or a MPC controller). r(t) stands for the measurement target, $u_c(t)$ is the controller output, d(t) is the process disturbances, u(t) is the actuator setpoint, y(t) is the measurement, and v(t) is the dither signal (PRBS) for closed-loop system identification (CLSID) at instant t.

The output y(t) can be calculated by $$y(t)=SPv(t)+Sd(t), \tag{6}$$

where the sensitivity function $$S=(1+PC)^{-1}. \tag{7}$$

Lemma 1: Matrix inversion formula:

$$(A+BTD)^{-1}=A^{-1}-A^{-1}B(T^{-1}+DA^{-1}B)^{-1}DA^{-1}$$

where A, T, and $(T^{-1}+DA^{-1}B)$ are non-singular.

By applying Lemma 1, the sensitivity function in (7) can be recast into, $$S=1-PC+PC(1+PC)^{-1}PC \tag{8}$$

In general, a CD process is decoupled into a spatial model component and a dynamic model component, $$P=Gh(z) \tag{9}$$

where G is the spatial response model (CD model), and h(z) is the dynamic response model (MD model). z is the z-transform factor.

Expand h(z) by using infinite impulse response (HR) representation, i.e., $$h(z)=h_{T_d}z^{-T_d}+h_{T_d+1}z^{-(T_d+1)}+h_{T_d+2}z^{-(T_d+2)}+h_{T_d+3}z^{-(T_d+3)}+\ldots. \tag{10}$$

where $T_d$ is the discrete time delay.

Insert (8) and (10) into (6), $$y(t)=h_{T_d}Gv(t-T_d)+h_{T_d-1}Gv(t-T_d-1)+\ldots+h_{2T_d-1}Gv(t-2T_d+1)+G_{yv}^{f}v(t)+Sd(t), \tag{11}$$

where, $G_{yv}^{f}$ is a fraction part of the closed loop transfer matrix, and it can be written by $$G_{yv}^{f}=(h_{2T_d}G+h_{T_d}NG)z^{-2T_d}+(h_{2T_d+1}G+h_{T_d+1}NG)z^{-(2T_d+1)}+(h_{2T_d+2}G+h_{T_d+2}NG)z^{-(2T_d+2)}+\ldots, \tag{12}$$

and N is causal and equal to $$N=-GC(1-SGCh(z))(h_{T_d}+h_{T_d+1}z^{-1}+h_{T_d+2}z^{-2}+\ldots).$$

It can be noticed that all terms of $G_{yv}^{f}$ has the factor z with power equal to or higher than $(-2T_d)$.

Lets define the non-disturbance-distorted output $y_u(t)$ $$y_u(t)=y(t)\cdot Sd(t).$$

Based on the above analysis in (11), one can conclude that the first $T_d$ terms of non-disturbance-distorted output $y_u(t)$ are independent of controller representation. By decoupling the first $T_d$ terms from non-disturbance-distorted output $y_u(t)$, the open loop spatial response model G can be identified.

Lets define the dither signal v(t) in FIG. 4, $$v(t)=U\phi(t),\ U\in\Re^n. \tag{13}$$

φ(t) is a PRBS signal in time domain, and satisfies $$R_\phi(\tau)=\begin{cases} R_\phi^o, & \text{if } \tau=0 \\ 0, & \text{if } \tau\neq 0, \end{cases} \tag{14}$$

where $R_\phi(\tau)$ stands for the autocovariance of φ(t) with the delay equal to τ, i.e., $$R_\phi(\tau)=E(\phi(t)\phi(t-\tau))). \tag{15}$$

Insert (13) into (11) and multiply $\phi(t-T_d)$ to the both sides of (11). Then we have, $$y(t)\phi(t-T_d)=h_{T_d}GU\phi(t-T_d)\phi(t-T_d)+h_{T_d+1}GU\phi(t-T_d-1)\phi(t-T_d)+\ldots+h_{2T_d-1}GU\phi(t-2T_d+1)\phi(t-T_d)+G_{yv}^{f}U\phi(t-2T_d)\phi(t-T_d)+Sd(t)U\phi(t-T_d). \tag{16}$$

Calculate the expectation of the both sides of (16), $$R_{y\phi}(\tau)=h_{T_d}GUR_\phi(0)+h_{T_d+1}GUR_\phi(1)+\ldots+h_{2T_d-1}GUR_\phi(T_d-1)+E(G_{yv}^{f}U)R_\phi(T_d)+E(Sd(t)\phi(t-T_d)) \tag{17}$$

where E is the operator of the expectation.

Let's assume that φ(t) is independent of every elements of the disturbance vector d(t) in the time domain, which is satisfied in most applications. Therefore, (17) can be simplified as $$R_{y\phi}(T_d)=h_{T_d}GUR_\phi^o \tag{18}$$

In the same fashion, we have $$R_{y\phi}(T_d+i)=h_{T_d-i}GUR_\phi^o,\ (i=1,2,\ldots,T_d-1) \tag{19}$$

Rewrite (19), and we finally derive $$\hat{g}_u=GU=\frac{R_{y\phi}(T_d+i)}{h_{T_d+i}R_\phi^o}\ (i=1,2,\ldots,T_d-1) \tag{20}$$

where $R_{y\phi}(T_d+i)=E(y(t+T_d+i)v(t))$, and $\hat{g}_u$ is the identified non-parametric open-loop response.

It can be further concluded that the static open loop response of a CD process can be extracted from closed loop experiment data by calculating the covariance between output measurements and PRBS excitation signals, and the autocovariance of PRBS excitations.

From (20), one can also extract the alignment information from the identified non-parametric open-loop response $\hat{g}_u$. In the next step, we formulate the alignment calculation as a standard nonlinear least square optimization problem, $$\theta_M=\text{argmin}\|g_M(\theta_M)-\hat{g}_u\|, \tag{21}$$

where $\theta_M$ stands for the alignment parameters. $g_u(\theta_M)$ is the predicted parametric open-loop response by using alignment parameter $\theta_M$. It can be the parameters of either a linear, a parametric nonlinear (the fuzzy logic model developed by D. M. Gorinevsky and C. Gheorghe, "Identification tool for cross-directional processes", *IEEE Transactions on Control Systems Technology*, Vol. 11, No. 5, 2003), or a non-parametric nonlinear function (curve-fitting proposed by B. R. Phillips, S. J. I'Anson and S. M. Hoole, "CD shrinkage profiles of paper—curve fitting and quantitative analysis", *Appita Journal of Peer Reviewed*, Vol. 55, No. 3, pp. 235-243, 2002.). The algorithm developed in the present invention has no specific requirements on the structure of shrinkage profiles. $\theta_M^o$ represents the optimal solution of the alignment parameters.

In summary, the inventive algorithm has the following features: (1) The algorithm is able to extract static open loop responses from closed-loop experimental data; (2) The algorithm provides the adaptive PRBS experiments, i.e., the structure for U in (13) is generated online; (3) The algorithm can tolerate both spatial uncertainties (process gain, response width, etc.), and dynamic uncertainties (time delay is allowed to have 100% uncertainty); (4) The algorithm provides the model validation scheme. A model qualifier is generated to facilitate online deployment; and (5) The algorithm can be potentially extended for the entire CD spatial model identification.

2. Mill Trial Results

Figure 5:
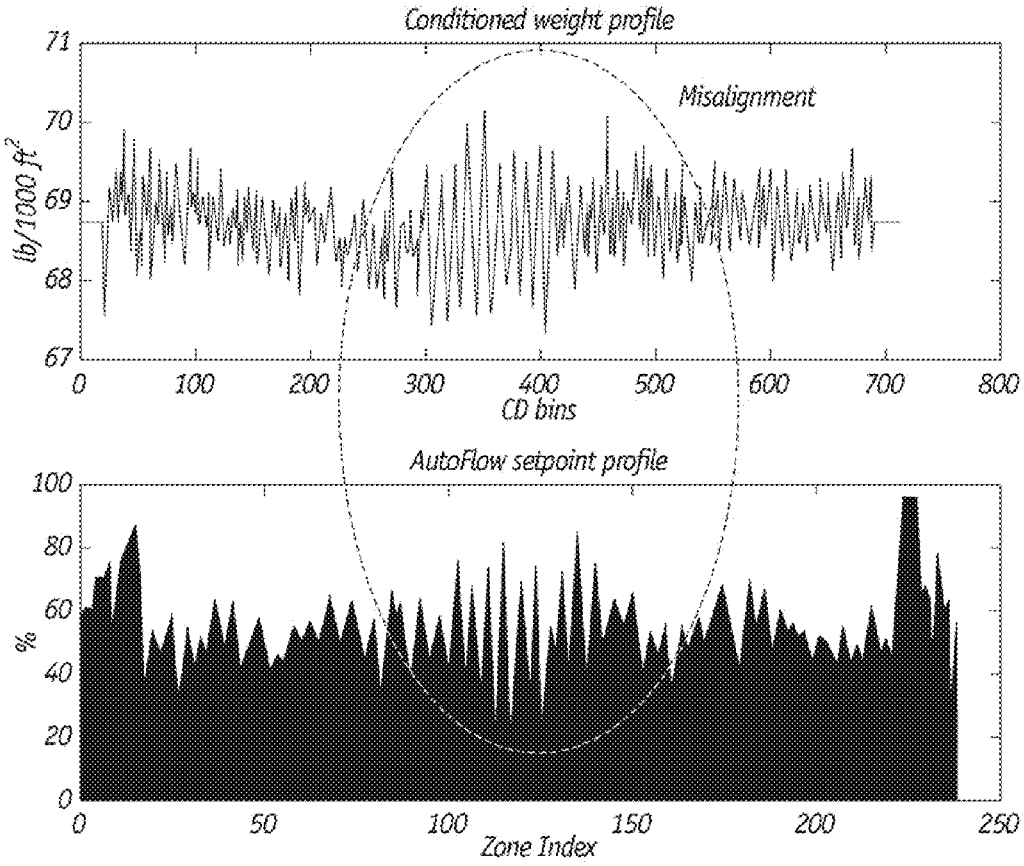
FIG. 5 shows the actuator setpoint profiles and measurement profile with a severe misalignment.

The inventive closed-loop monitoring and identification of CD alignment technique has been successfully tested in commercial paper mills. At one facility, the papermaking machine was a large-scale heavy board machine with a 9.6 meters trim that operated at over 400 meters per minute. It was fitted with a dilution headbox, water spray, steambox, and induction heating CD actuators to control conditioned weight, moisture and thickness. Due to the narrow spacing between the dilution headbox actuators, this machine had been very sensitive to misalignment. For instance, the actuators would start picketing in the presence of a one-third zone width misalignment in the dilution headbox actuators as shown in FIG. 5. Previous to implementation of the inventive CD alignment process, when picketing was detected, operators would have to turn off the feedback CD control and realign the system by carrying on an open-loop bump test. This process was time consuming work.

2.1 Online Detection Mill Trial Results

Figure 6:
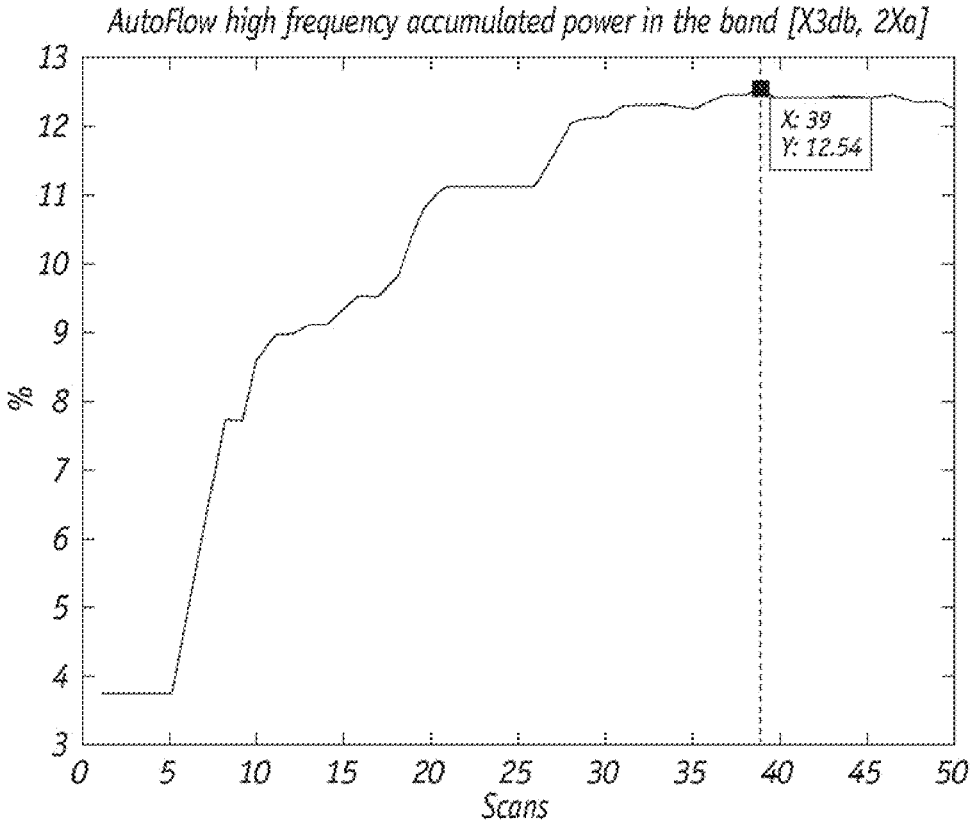
FIG. 6 shows the spread of high frequency accumulated powers during baselining.

As described in section 1.1, online detection is configured after the controller has performed baselining. FIG. 6 illustrates the baselining process. FIG. 6 is the trend of high frequency accumulated powers for actuator (AutoFlow) setpoint profiles during the baselining process. (AutoFlow refers to a headbox dilution process. A set of uniform dilution jets is installed before the headbox chamber across the paper machine. By adding the dilution fluid, the local consistency of stock flow can be affected, and consequently local base weight is changed. Usually Autoflow is used as a basis weight actuators although it has the effect on other paper qualities too, like moisture and thickness.) Here, the high frequency band for measurements is set to [X3db, Xc], and the high frequency band for actuators is set to [X3db, 2Xa]. The notation X3db stands for the frequency point where the spatial power drops to 50% of the maximum spatial power over the full spatial frequency band, Xc stands for the frequency point where the spatial power drops to 4% of the maximum, and 2Xa stands for the two times of actuator spacing. From FIG. 6, we can determine that baselining threshold for the actuator equal to $\delta_u$=12.54 during the baselining process. Also, optionally we can add the baselining threshold for the measurement $\delta_y$=0.151, which can be measured in the same fashion, for picketing detection. During baselining, actuator picketing was barely observed by visual inspection. In this test, the baselining scan number was set at 50.

Figure 7A:
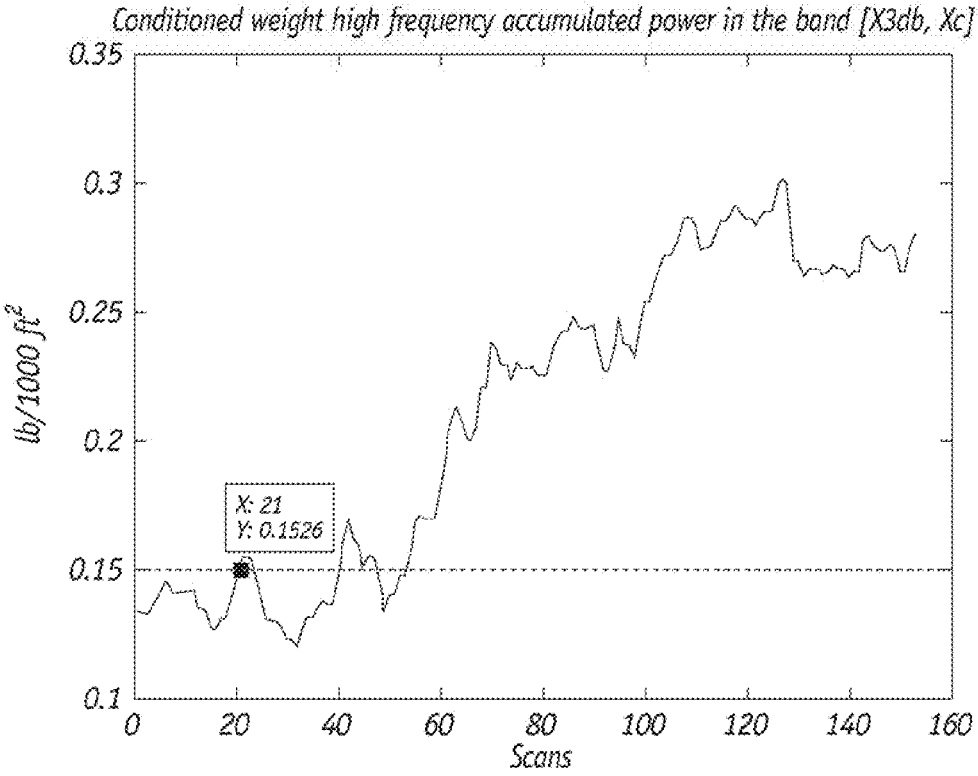
FIGS. 7A and 7B show the spread of high frequency accumulated powers when a half-zone width paper wander occurs.
Figure 7B:
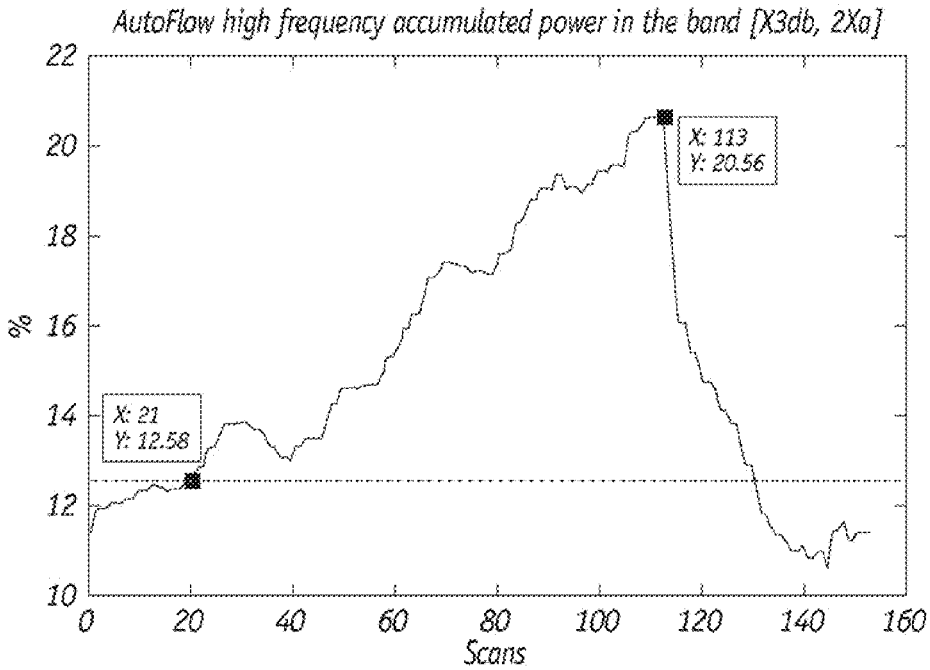
Figure 8:
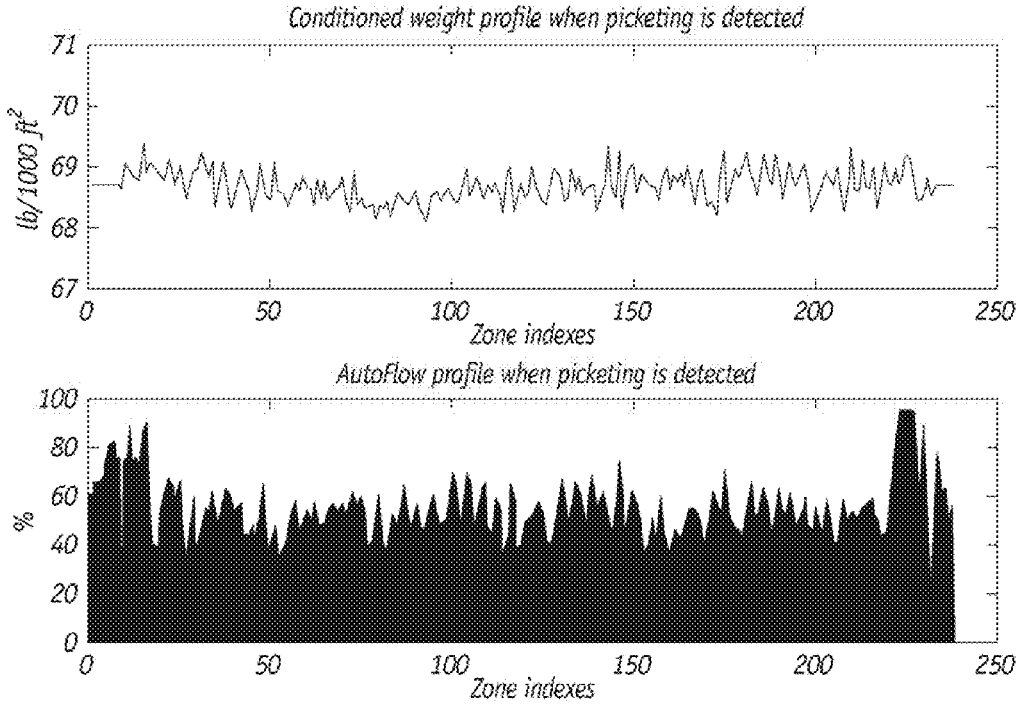
FIG. 8 shows the buffered profiles when the actuator picketing is detected.

For the online detection algorithm, the thresholds $\delta_u$ and $\delta_y$ were used to monitor the alignment in closed-loop. This test was conducted when the paper machine experienced a half-zone width sheet wander. FIGS. 7A and 7B show the spread of high frequency accumulated powers for both the measurement profiles and actuator setpoint profiles during monitoring, respectively. It can be seen that at scan 21, both the measurement high frequency spread and the actuator high frequency spread were higher than the thresholds. At this juncture, picketing was detected which automatically triggered the closed-loop alignment identification. In order to test the reliability and efficiency of the detection algorithm, the automatic closed-loop identification was temporarily disabled; this allowed the profile to develop fully as there was no alignment update. At scan 113 (see the data cursor on the plot of AutoFlow high frequency accumulated power in FIG. 7B), picketing is apparent by visual inspection. It was then decided to increase the picketing penalty (smoothing factor) at this moment to bring the spread of both actuator setpoint and measurement profiles down. This is the reason for the high frequency accumulated power drop after scan 113 as shown in FIG. 7B. FIG. 8 shows the saved profiles whenever the picketing is detected (at scan 21). By visual inspection only, it is very difficult to clearly see any actuator picketing.

Figure 9:
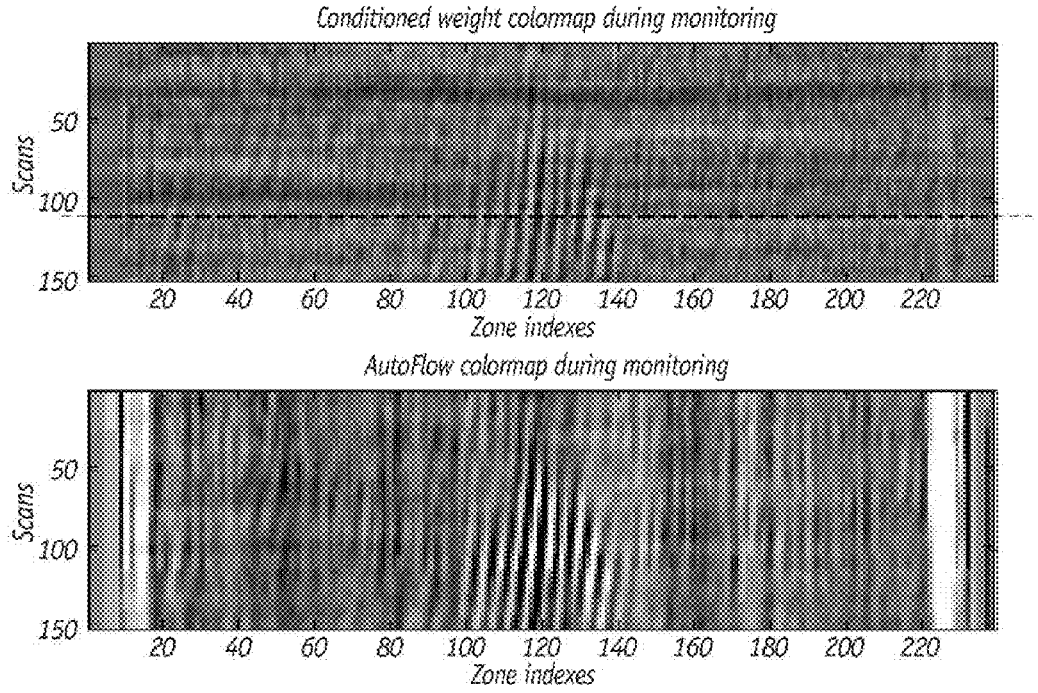
FIG. 9 shows gray color maps of buffered profiles when a half-zone width sheet wander occurs.

FIG. 9 shows the gray color maps of the testing profiles. The profiles are not as distinct towards the end of test. In FIG. 9, the dash line indicates the time when the extra picketing penalty (more conservative MPC tuning) was deployed. As noted above, at scan 113, an operator would probably cite misalignment and carry on an open-loop bump test to re-align the process. However, with the inventive monitoring and identification process in operation, the detection algorithm would initiate the closed-loop identification automatically at scan 21, long before any alignment issue is apparent from visual inspection.

2.2 Closed Loop Identification Mill Trial Results

Figure 10:
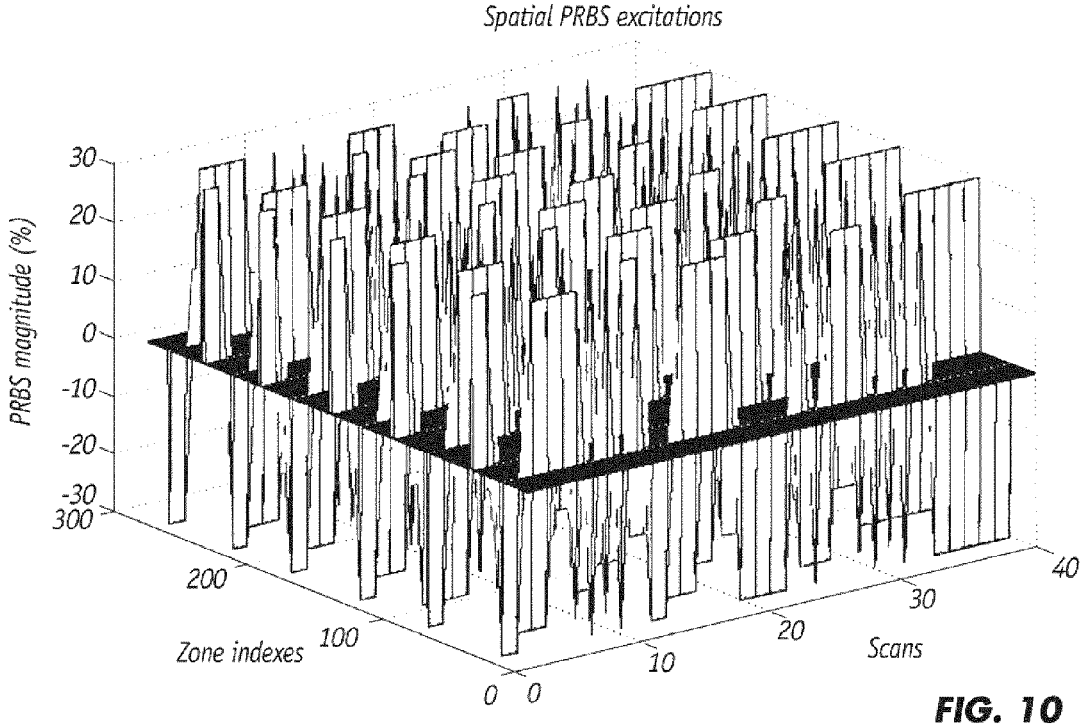
FIG. 10 shows the closed-loop PRBS excitations.

Online alignment identification includes two stages: data collection and running identification. FIG. 10 illustrates the spatial PRBS excitations. It can be seen that a set of individual actuators (AutoFlow) is bumped. These bumps are not persistent in the time domain (MD); instead, they are PRBS (pulses with constant magnitude and different duration). The dither signal v(t) is added at the top of CD controller output (see FIG. 4 for the process configuration). Therefore, the feedback control still tries to maintain product specifications.

Figure 11:
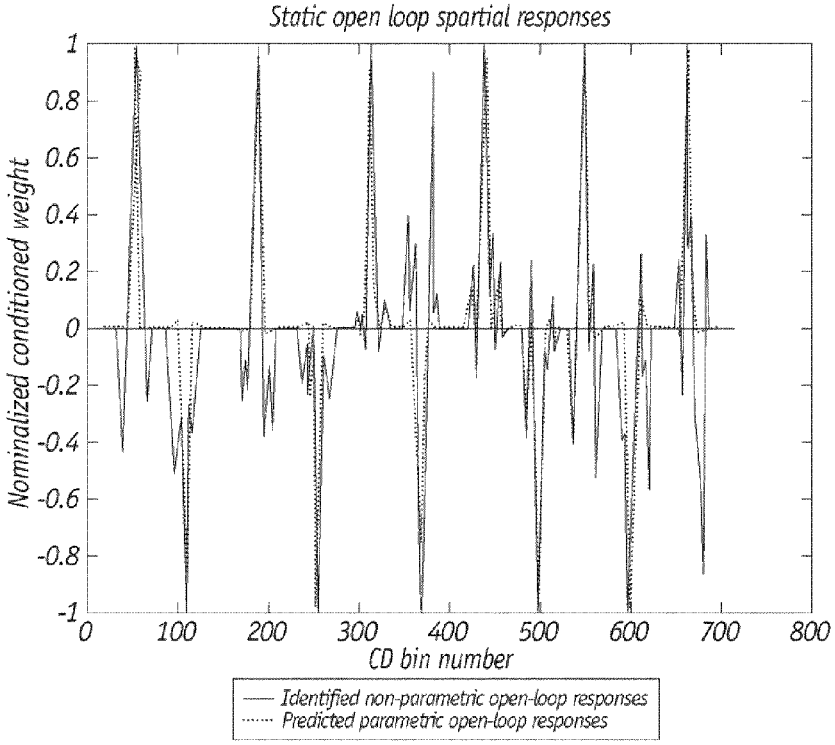
FIG. 11 shows the closed-loop identification results.
Figure 12A:
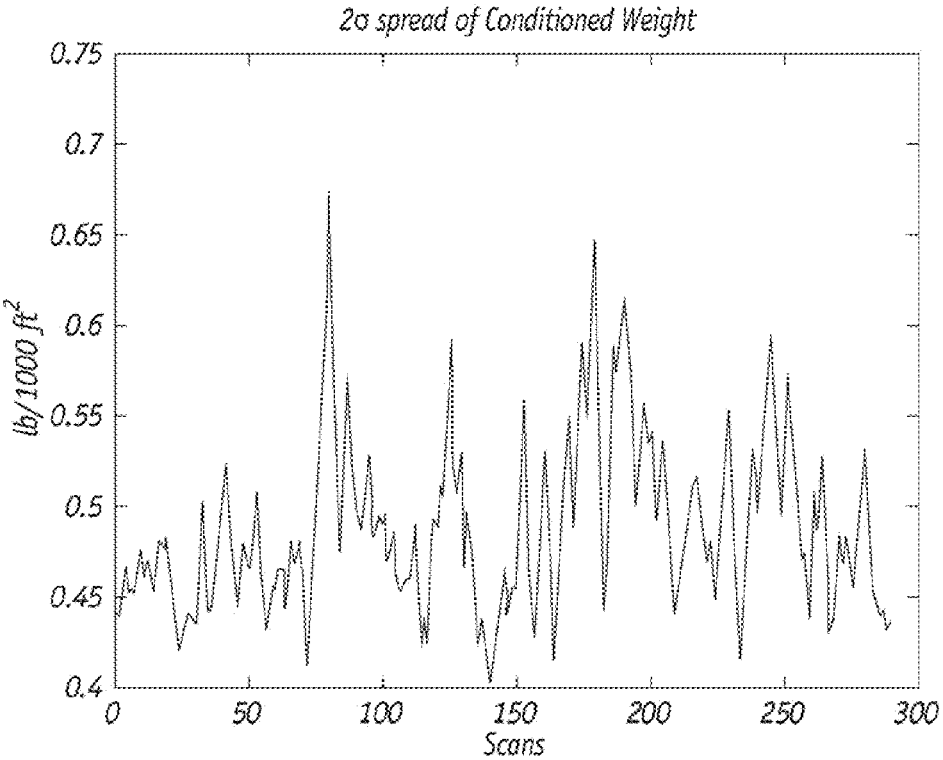
FIGS. 12A and 12B show the 2σ spread of logged data during three consecutive PRBS tests.
Figure 12B:
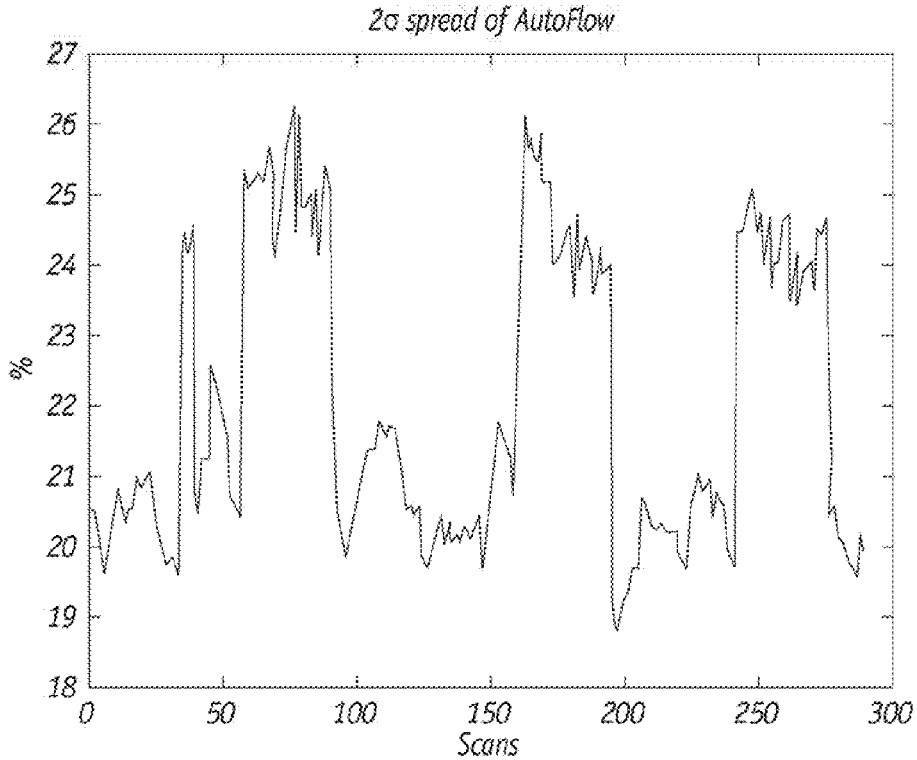

FIG. 11 shows the closed-loop identification results. The solid line denotes the identified non-parametric open-loop responses and the dotted line denotes the predicted parametric open-loop responses by using the new alignment. It can be seen that the peak locations of the two curves match very well. By using INTELLIMAP which is a commercially available open-loop CD modeling tool from Honeywell International, Inc. (Morristown, N.J.), the identified low actuator offset (the distance between the low edge of the sheet and the edge of the first actuator zone) is 60 mm, and the identified high actuator offset (the distance between the high edge of the sheet and the edge of the last actuator zone) is 85 mm. By using the inventive alignment technique, the low and high were 62 mm and 86 mm, respectively. Comparing to the actuator zone width (42.3 mm), the results of identification are very accurate. FIGS. 12A and 12B illustrates the spreads of measurement profiles and actuator setpoint profiles during three consecutive PRBS tests. It can be seen that the effect of PRBS tests on the quality of paper product is minor. As we mentioned above, closed-loop PRBS tests did not interrupt paper machine normal operations and introduced only very small variances during tests.

2.3 Online Deployment

Figure 13:
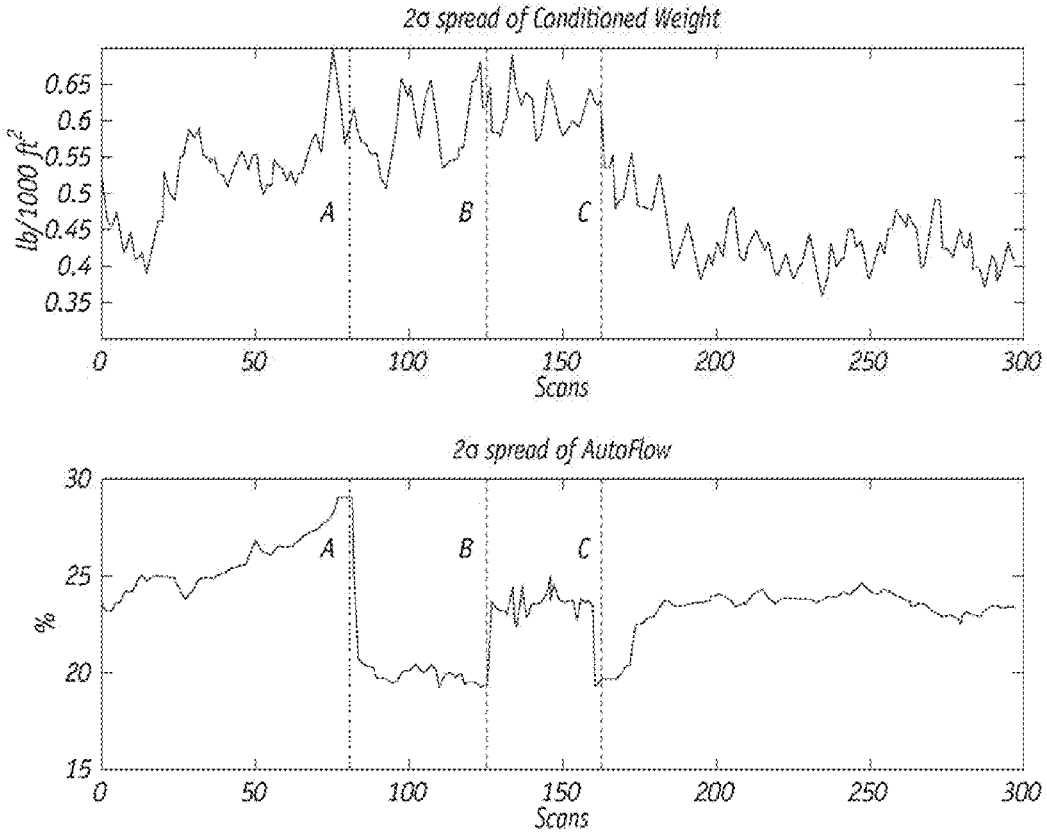
FIG. 13 shows the 2σ spread of profiles during the entire process of using the inventive closed-loop cross-directional alignment technique.

FIG. 13 illustrates the overall process of using the inventive alignment technique. The vertical dash line A in FIG. 13 indicates the instant when actuator picketing is detected. The inventive alignment technique then retunes the MPC controller in order to stabilize the process (using more conservative tuning parameters). After the process settles down, i.e. both actuator setpoint variance and measurement variance (2σ spreads) settles down, the technique starts a closed-loop PRBS test at instant B (the vertical dash line B in FIG. 13). At instant C (the vertical dash line C in FIG. 13), the closed-loop alignment identification is complete. In addition, the technique deploys the new alignment and the original MPC controller tuning is restored at instant C. It is obvious that both actuator setpoint variance and measurement variance (2σ spreads) drop significantly after using the new alignment (comparing with the situation at instant A). In other words, after deploying the new alignment the control performance of this system has improved significantly. The results demonstrate that the inventive technique is adaptive, efficient, and robust.

The foregoing has described the principles, preferred embodiment and modes of operation of the present invention. However, the invention should not be construed as limited to the particular embodiments discussed. Instead, the above-described embodiments should be regarded as illustrative rather than restrictive, and it should be appreciated that variations may be made in those embodiments by workers skilled in the art without departing from the scope of present invention as defined by the following claims.

What is claimed is:

1. A method for detecting misalignment of a sheetmaking system having a plurality of actuators arranged in the cross-direction and having a cross-directional (CD) controller for providing control to a spatially-distributed sheet process which is employed in the sheetmaking system, the method comprising the steps of:

(a) operating the system and measuring a profile of the sheet along the cross-direction of the sheet downstream of the plurality of actuators and generating a profile signal that is proportional to a measurement profile;

(b) tuning the CD controller with an acceptable CD alignment;

(c) initiating artificial misalignment;

(d) performing baselining operations to establish baseline threshold detection conditions;

(e) monitoring the operating conditions;

(f) signaling misalignment when operating conditions exceed the threshold detection conditions.

2. The method of claim 1 wherein step (c) comprises changing sheet wander or overall sheet shrinkage.

3. The method of claim 1 wherein step (d) comprises calculating a maximum high frequency accumulated power in a certain frequency band for actuator setpoint profiles and/or measurement profiles and using the maximums as the threshold detection conditions.

4. The method of claim 1 wherein step (a) comprises scanning the sheet along the cross-direction to measure the profile or using sensor arrays along the cross-direction to measure the instantaneous measurement profiles.

5. The method of claim 1 wherein step (e) comprises calculating the high frequency accumulated power in a preselected frequency band for actuator setpoint profiles and/or measurement profiles at each scan.

6. The method of claim 1 wherein step (f) comprises triggering an online identification if the current high frequency accumulated power is higher than the threshold detection conditions.

7. The method of claim 1 wherein the controller is a multivariable model predictive controller or a single-input-single-output controller.

8. A method of closed-loop alignment identification of a sheetmaking system having a plurality of actuators arranged in the cross-direction and having a cross-directional (CD) controller for providing control to a spatially-distributed sheet process which is employed in the sheetmaking system, the method comprising the steps of:

(a) initiating a closed-loop pseudo-random binary sequence (PRBS) bump tests to generate experimental data;

(b) extracting non-parametric open-loop responses from the experimental data;

(c) identifying alignment by using identified non-parametric open-loop responses;

(d) validating the alignment; and (e) signaling online deployment based on alignment validation.

9. The method of claim 8 wherein step (a) comprises designing excitation signals for the PRBS tests, wherein $v(t) = U\phi(t)$ is the dither signal wherein (i) $\phi(t)$ defines excitation signal properties in the time domain such that in time domain, the excitation signal is a PRBS and (ii) U defines signal properties in the spatial domain that specifies locations of injected excitation signals and magnitude of excitation signals.

10. The method of claim 8 wherein step (b) comprises extracting open-loop responses from the experimental data using process time delay components.

11. The method of claim 8 wherein step (d) comprises executing a model validation algorithm that compares (i) fitness of identified non-parametric open-loop responses versus predicted parametric open-loop responses using identified alignment parameters to (ii) fitness of identified non-parametric open-loop responses versus predicted parametric open-loop responses using prior alignment parameters.

12. An online method of deploying alignment of a sheetmaking system having a plurality of actuators arranged in the cross-direction wherein the system includes a controller for adjusting outputs of the plurality of actuators in response to sheet profile measurements that are made downstream from the plurality of actuators wherein the controller is initially operated under original tuning parameters, the method comprising the steps of:

(a) detecting cross-directional misalignment;

(b) identifying cross-directional alignment by implementing a closed-loop pseudo-random binary sequence (PRBS) bump test; and (c) validating identified cross-directional alignment whereby (i) if the identified alignment is determined to be within a first range that is referred to as being good, the identified alignment is transferred to the controller with the proviso that in the case where the CD had been detuned prior to step (b) and provided with more conservative tuning parameters, the CD is restored with the original tuning parameters; (ii) if the identified alignment is determined to be within a second range that is referred to as being fair, the identified alignment is transferred to the controller with the proviso that that in the case where the CD had been detuned prior to step (b) and provided with more conservative tuning parameters, the CD is not restored with the original tuning parameters; and (iii) if the identified alignment is determined to be within a third range that is referred to as being poor, the identified alignment is not transferred.

13. The method of claim 12 wherein the case that the identified alignment is determined to be fair or poor, the method repeats steps (b) and (c) by implementing another PRBS bump test under different parameters.

14. A method of alignment of a sheetmaking system having a plurality of actuators arranged in the cross-direction wherein the system includes a controller for adjusting outputs to the plurality of actuators in response to sheet profile measurements that are made downstream from the plurality of actuators, the method comprising the steps of:

(a) detecting misalignment that comprises the steps of:

(i) operating the system and measuring a profile of the sheet along the cross-direction of the sheet downstream of the plurality of actuators and generating a profile signal that is proportional to a measurement profile;

(ii) inject artificial misalignment;

(iii) performing baselining operations to establish baseline threshold detection conditions, (iv) monitoring the operating conditions;

(v) signaling misalignment when operating conditions exceed the threshold detection conditions;

(b) identifying alignment that comprises the steps of:

(i) initiating a closed-loop pseudo-random binary sequence (PRBS) bump tests to generate experimental data;

(ii) extracting open-loop responses from the experimental data;

(iii) identifying alignment by using open-loop responses;

(iv) validating the alignment; and (v) signaling online deployment based on alignment validation; and (c) deploying the alignment.

15. The method of claim 14 wherein step (a)(ii) comprises changing sheet wander or overall sheet shrinkage.

16. The method of claim 14 wherein step (a)(iv) comprises calculating a maximum high frequency accumulated power in a certain frequency band for actuator setpoint profiles and/or measurement profiles and using the maximums as the threshold detection conditions.

17. The method of claim 14 wherein step (a)(iv) comprises calculating the high frequency accumulated power in a preselected frequency band for actuator setpoint profiles and/or measurement profiles at each scan.

18. The method of claim 14 wherein step (a)(v) comprises triggering an online identification if the current high frequency accumulated power is higher than the threshold detection conditions.

19. The method of claim 14 wherein step (b)(ii) comprises extracting open-loop responses from the experimental data using process time delay components.

20. The method of claim 14 wherein step (b)(iv) comprises executing a model validation algorithm that compares (i) fitness of identified non-parametric open-loop responses versus predicted parametric open-loop responses using identified alignment parameters to (ii) fitness of identified non-parametric open-loop responses versus predicted parametric open-loop responses using prior alignment parameters.

* * * * *